US008325955B2

(12) United States Patent
Tang

(10) Patent No.: US 8,325,955 B2
(45) Date of Patent: Dec. 4, 2012

(54) METHOD FOR IMPROVING COMPATIBILITY OF HEARING AID WITH ANTENNA

(75) Inventor: Chia-Lun Tang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 1073 days.

(21) Appl. No.: 12/049,694

(22) Filed: Mar. 17, 2008

(65) Prior Publication Data

US 2009/0232337 A1 Sep. 17, 2009

(51) Int. Cl.
*H04R 25/00* (2006.01)

(52) U.S. Cl. ..... 381/315; 381/312; 381/313; 381/314; 381/316; 381/331

(58) Field of Classification Search ..... 381/23.1, 381/315
See application file for complete search history.

(56) References Cited

U.S. PATENT DOCUMENTS 3,742,358 A * 6/1973 Cesaro ..... 455/9
6,249,256 B1 * 6/2001 Luxon et al. ..... 343/702
6,510,058 B1 * 1/2003 Kozakiewicz ..... 361/760
6,707,682 B2 * 3/2004 Akiba et al. ..... 361/763
6,855,883 B1 * 2/2005 Matsui ..... 174/393
6,856,131 B2 * 2/2005 Miyazawa et al. ..... 324/252
6,927,730 B2 * 8/2005 Tang et al. ..... 343/700 MS
7,209,087 B2 * 4/2007 Tang et al. ..... 343/702
7,292,193 B2 * 11/2007 Jang ..... 343/702
7,362,271 B2 * 4/2008 Iwai et al. ..... 343/700 MS
7,385,557 B2 * 6/2008 Kim ..... 343/702
7,471,249 B2 * 12/2008 Tang et al. ..... 343/702
7,498,990 B2 * 3/2009 Park et al. ..... 343/702
7,612,722 B2 * 11/2009 Haho et al. ..... 343/702
7,829,810 B2 * 11/2010 Nakajima ..... 200/333
7,982,676 B2 * 7/2011 Chen et al. ..... 343/702
2002/0015293 A1 * 2/2002 Akiba et al. ..... 361/793
2002/0126049 A1 * 9/2002 Okabe et al. ..... 343/700 MS
2004/0212535 A1 * 10/2004 Tang et al. ..... 343/700 MS
2005/0243009 A1 * 11/2005 Wong et al. ..... 343/829
2006/0071871 A1 * 4/2006 Tang et al. ..... 343/826
2006/0089184 A1 * 4/2006 Kim et al. ..... 455/575.5
2006/0145924 A1 * 7/2006 Chen et al. ..... 343/700 MS
2007/0003088 A1 * 1/2007 Lehtola ..... 381/330
2007/0046543 A1 * 3/2007 Choi et al. ..... 343/700 MS
2007/0109196 A1 * 5/2007 Tang et al. ..... 343/700 MS
2007/0159380 A1 * 7/2007 Nagaishi et al. ..... 342/70
2007/0176833 A1 * 8/2007 Haho et al. ..... 343/702
2007/0296638 A1 * 12/2007 Kim et al. ..... 343/702
2008/0007468 A1 * 1/2008 Sato et al. ..... 343/702
2008/0039043 A1 * 2/2008 Yamazaki et al. ..... 455/269
2008/0079642 A1 * 4/2008 Ishizuka et al. ..... 343/702
2008/0136597 A1 * 6/2008 Choi et al. ..... 340/10.1
2008/0204340 A1 * 8/2008 Kim et al. ..... 343/770
2009/0009407 A1 * 1/2009 Hong et al. ..... 343/702

(Continued)

*Primary Examiner* — Fernando L Toledo
*Assistant Examiner* — Mohammed Shamsuzzaman
(74) *Attorney, Agent, or Firm* — Guice Patents PLLC

(57) ABSTRACT

A method for improving compatibility of a hearing aid with an antenna, in which at least a metal frame is provided near by a grounding surface of the antenna to change the direction of radiation of the antenna, thereby to enhance the directivity of the antenna on the side away from a hearing aid, and to reduce the quantity of radiation proceeding toward the hearing aid and to improve the near-field quantity (for about 3 dB) of an electric field of an HAC tested plane. This method can further increase the heights of the metal frames to reduce the near-field quantity of the electric field of HAC (hearing aid compatibility) tested plane.

5 Claims, 12 Drawing Sheets

U.S. PATENT DOCUMENTS

2010/0021176 A1* 1/2010 Holcombe et al. ..... 398/115
2010/0026580 A1* 2/2010 Tang ..... 343/700 MS
2010/0033380 A1* 2/2010 Pascolini et al. ..... 343/700 MS
2010/0103068 A1* 4/2010 Chen et al. ..... 343/841
2010/0109953 A1* 5/2010 Tang ..... 343/700 MS
2010/0164808 A1* 7/2010 Chang et al. ..... 343/700 MS

* cited by examiner

1900 MHz

E-Field

H-Field

1900 MHz

E-Field

H-Field

1900MHz

1900MHz

1900MHz

1900MHz

METHOD FOR IMPROVING COMPATIBILITY OF HEARING AID WITH ANTENNA

BACKGROUND OF THE INVENTION

1. Field of the Invention

The present invention relates to a method for improving compatibility of a hearing aid with an antenna, and especially to a method that adds at least a metal frame near by a grounding surface of the antenna to lower the near-field quantity of an HAC (hearing aid compatibility) tested plane.

2. Description of the Prior Art

In using a hearing device (such as a hearing aid) for a wireless device, a user may hear a noise such as bi . . . , ng . . . or a long noise; some hearing devices has better ability in eliminating these interferences of noises, different wireless devices may have different amount of interference. When a digital mobile phone and a hearing aid are used simultaneously, an electric field may be induced near an antenna of the mobile phone, the pulse energy of its magnetic field may be absorbed by a microphone or a communication coil of the hearing aid and will be a sound of ghi . . . ghi . . . heard by a user of the hearing aid. American National Standards Institute (ANSI) established a specification of ANSI C63.19, FCC required that manufacturers of mobile phones and service providers of mobile phones must have more than 50% of their products satisfying the rules of limitation about the hearing aid EMI required by ANSI C63.19 since Feb. 18, 2008.

The standards of test of the rule specification about HAC (hearing aid compatibility) of ANSI C63.19 are as below:

a. a testing probe is used to measure electromagnetic field quantity of a plane of 5×5 $cm^2$ which is 15 mm above a sound outlet of a mobile phone;
b. the tested plane is divided into 9 blocks, the maximum electromagnetic field strength of each block is taken;
c. the maximum electromagnetic strength of each of the blocks is used to define its class of HAC;
d. The differences between these classes of HAC are defined by a value of 5 dB, they are classes M1, M2, M3 and M4 (in which M3 and M4 meet the stipulated rule).

Thus for an antenna, we generally observe at the same time the HAC classes of their electric fields and magnetic fields, and take the worst class to define the HAC value of frequency spot.

The method of the present invention mainly is for lowering the strength of the electric field in a tested plane of an antenna, the strength can be lowered for about 3 dB, this can get an effective directly improvement for some antenna designs in critical states against the rule specification.

SUMMARY OF THE INVENTION

Thereby, the present invention is a method for improving compatibility of a hearing aid with an antenna, in which at least a metal frame is provided near by a grounding surface of the antenna to change the direction of radiation of the antenna, thereby to enhance the directivity of the antenna on the side away from a hearing aid, and to reduce the quantity of radiation proceeding toward the hearing aid and to improve the near-field quantity (for about 3 dB) of an electric field of an HAC (hearing aid compatibility) tested plane.

Moreover, the method provided by the present invention can further increase the height of the metal frames to reduce the near-field quantity of the electric field of the HAC (hearing aid compatibility) tested plane.

The present invention will be apparent after reading the detailed description of the preferred embodiment thereof in reference to the accompanying drawings.

DETAILED DESCRIPTION OF THE PREFERRED EMBODIMENT

The present invention mainly is to provide a method for improving compatibility of a hearing aid with an antenna, in which at least a metal frame is provided near by a grounding surface of the antenna to change the direction of radiation of the antenna, thereby to enhance the directivity of the antenna on the side away from a hearing aid, and to reduce the quantity of radiation proceeding toward the hearing aid and to improve the near-field quantity (for about 3 dB) of an electric field of an HAC (hearing aid compatibility) tested plane.

One metal frame or a plurality of metal frames can be provided at one side or at plural sides of the grounding surface of the antenna, both are able to reduce the near- field quantity of the electric field of an HAC tested plane.

The method of the present invention basically has no influence on the efficiency of the antenna, while is substantially benefit to adjustment of the hearing aid compatibility (HAC). Moreover, the near-field quantity of the HAC (hearing aid compatibility) tested plane can be lowered gradually by the present invention in pursuance of increasing of the heights of the metal frames; and the method of the present invention is applicable to any type of antenna, the following experiment takes an inversed F type antenna (PIFA) to verify this, the lengths and the width of the tested plane are both 15 mm, the input power used is 1 W, the testing frequency is 1900 MHz.

Figure 1A:
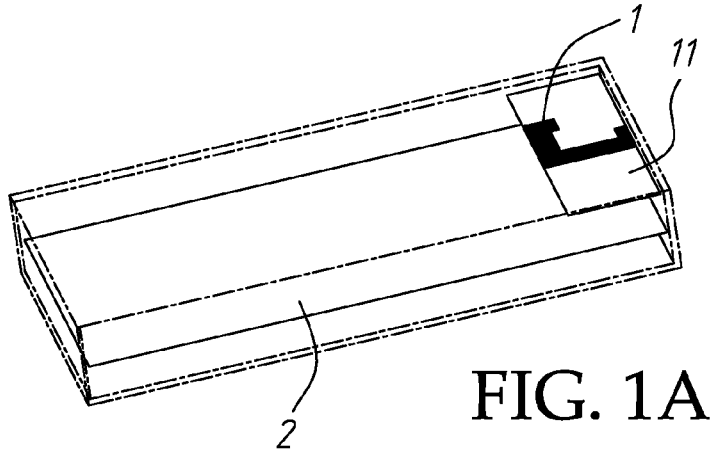
FIG. 1A to FIG. 1C are schematic views of an antenna in a first test example of the present invention.
Figure 1B:
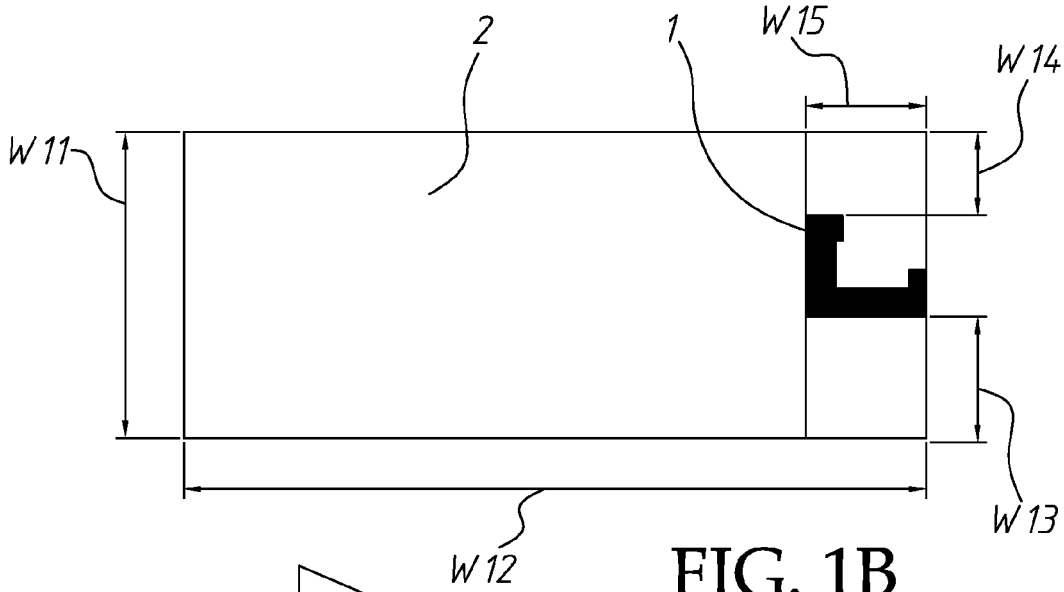
Figure 1C:
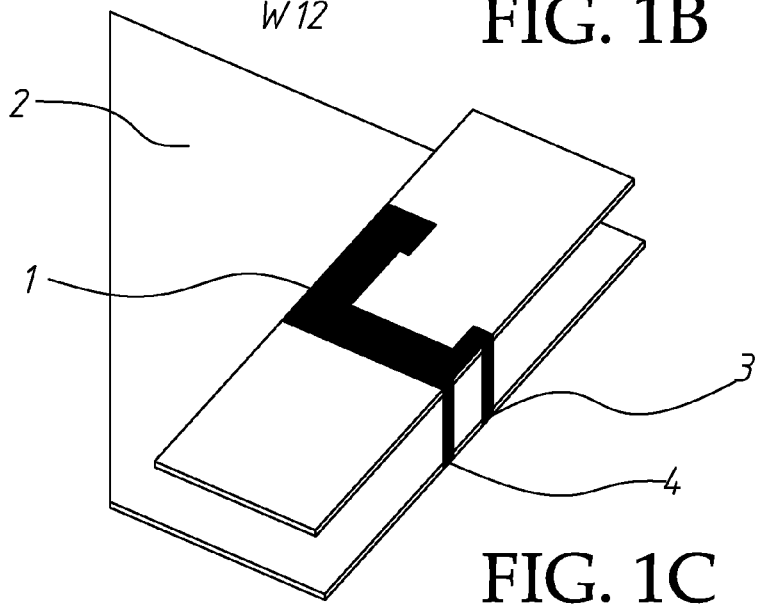

Referring particularly to FIGS. 1A to 1C which show a first test example of the present invention, the antenna has a metal radiating member 1 placed on a carrier plate 11 of the antenna and connected with a grounding surface 2; the metal radiating member 1 has a grounding spot 3 and a feed in spot 4 extending therefrom to connect with the grounding surface 2.

The grounding surface 2 of the antenna depicted in FIGS. 1A to 1C has no metal frame therearound, the data of the antenna are list below:

W11=45 mm
W12=100 mm
W13=18 mm
W14=12 mm
W15=16 mm

Figure 2:
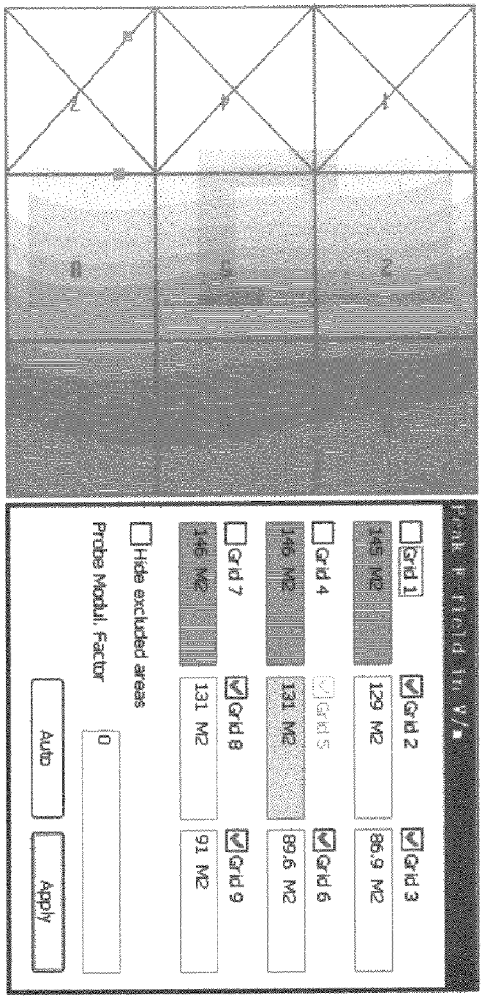
FIG. 2 shows a test result of HAC of the first test example as shown in FIG. 1A.
Figure 2:
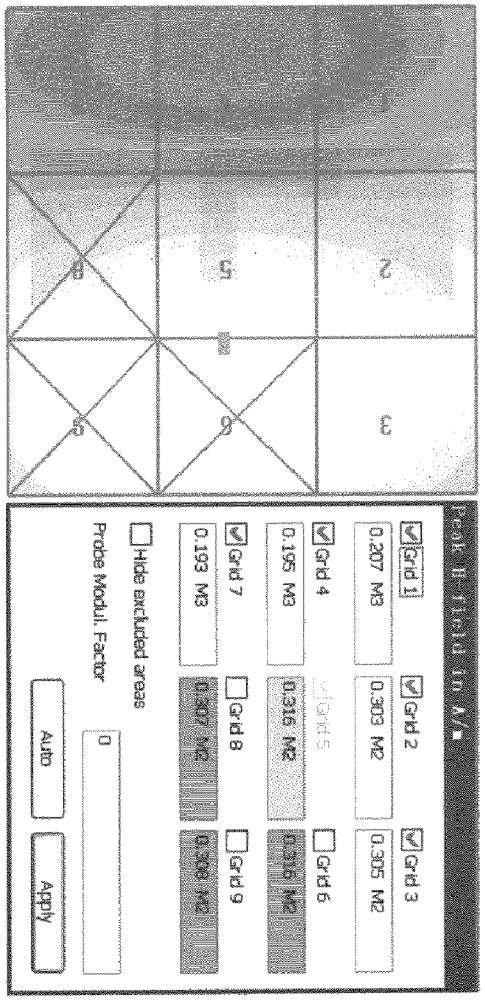

In FIG. 2 which shows a test result of HAC (hearing aid compatibility) of the first test example, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

Figure 3A:
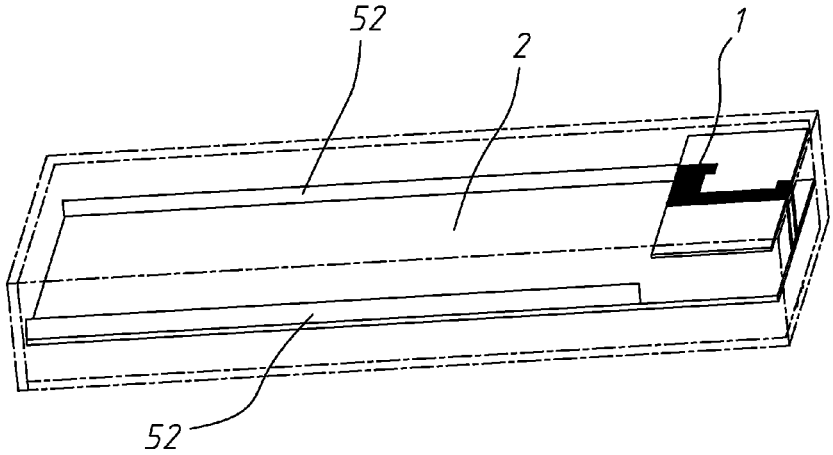
FIG. 3A to FIG. 3B are schematic views of an antenna in a second test example of the present invention.
Figure 3B:
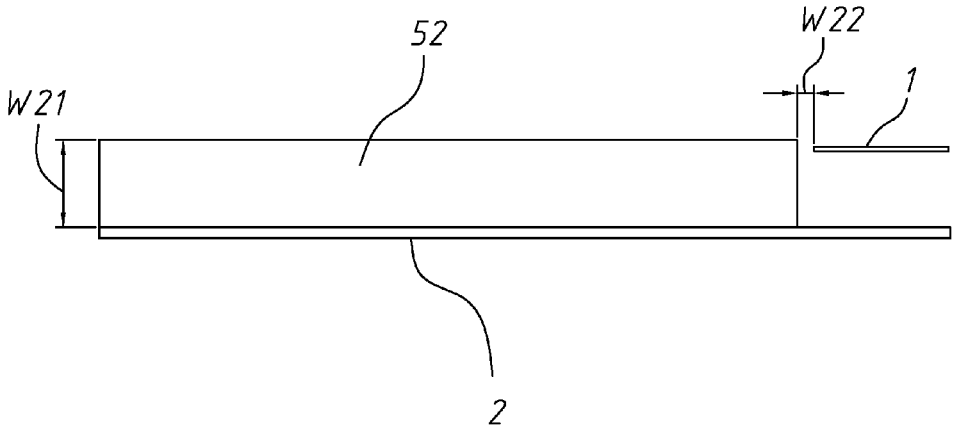

FIGS. 3A and 3B show a second test example of the present invention, in which the antenna is same by size as that of the first test example, however, the grounding surface 2 of the antenna is provided on its upper and lower sides each with a metal frame 52 (please refer to FIG. 3B), the data of size of it are list below:

W21=2.5 mm
W22=2 mm

Figure 4:
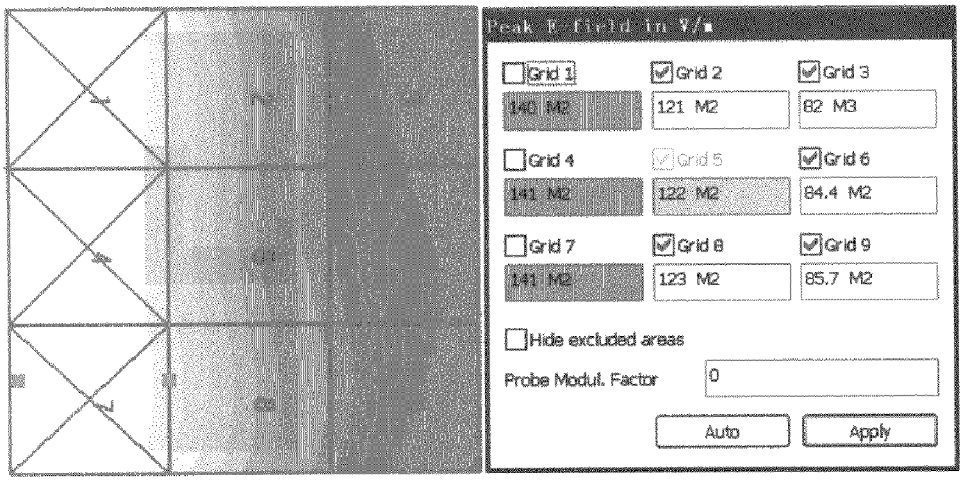
FIG. 4 shows a test result of HAC of the second test example as shown in FIG. 3A.
Figure 4:
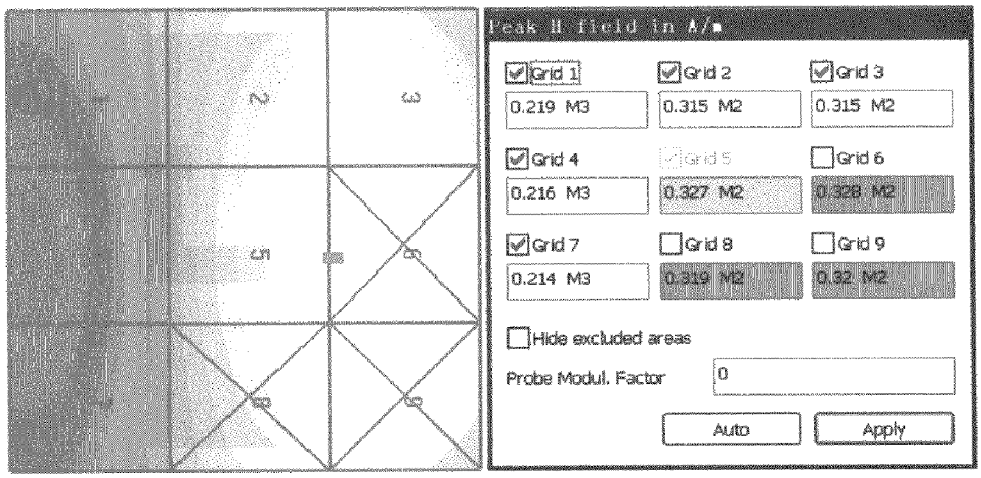

In FIG. 4 a test result of HAC (hearing aid compatibility) of the second test example is shown, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

Figure 5A:
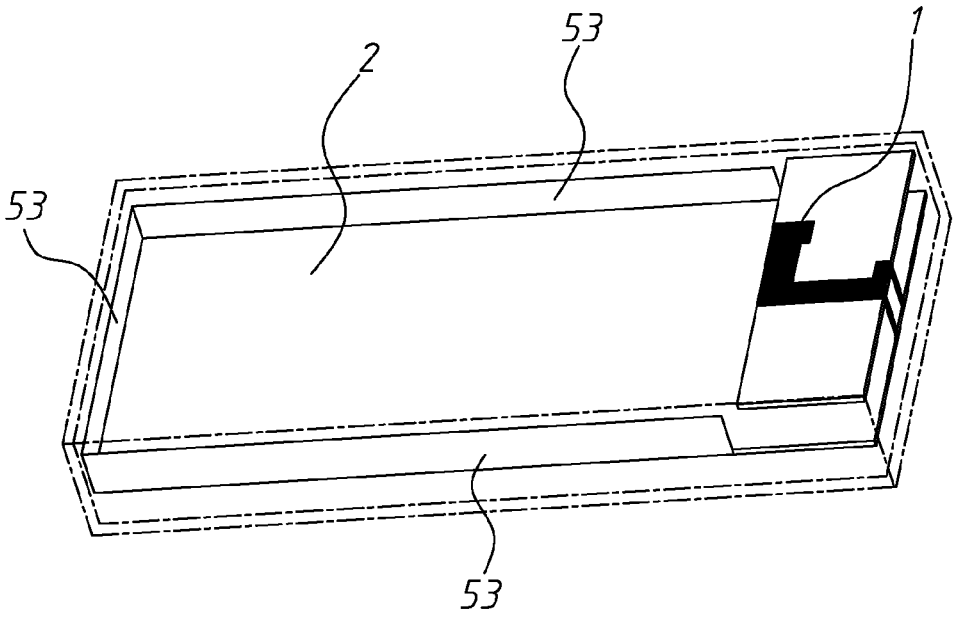
FIG. 5A to FIG. 5B are schematic views of an antenna in a third test example of the present invention.
Figure 5B:
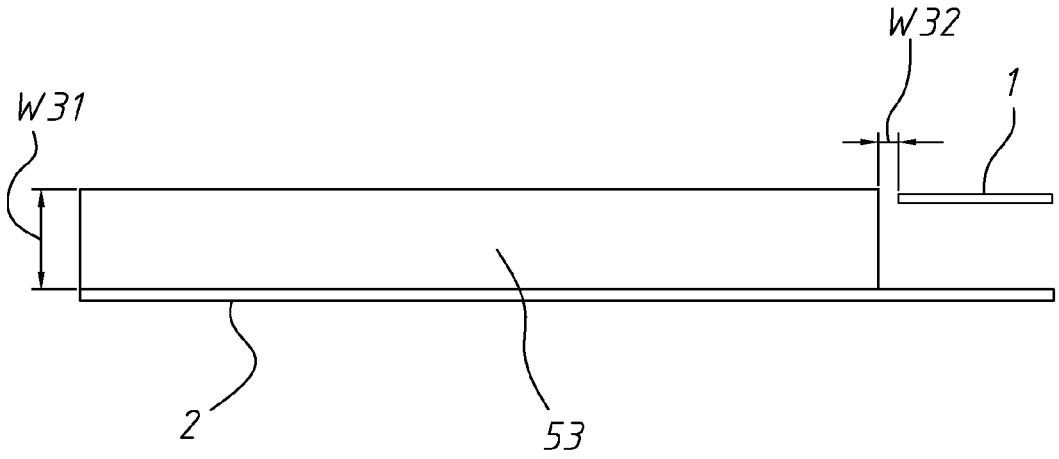

FIGS. 5A and 5B show a third test example of the present invention, in which the antenna is same by size as that of the second test example, however, the grounding surface 2 of the antenna is provided on its three sides each with a metal frame 53, the sizes of it are list below:

W31=5 mm
W32=2 mm

Figure 6:
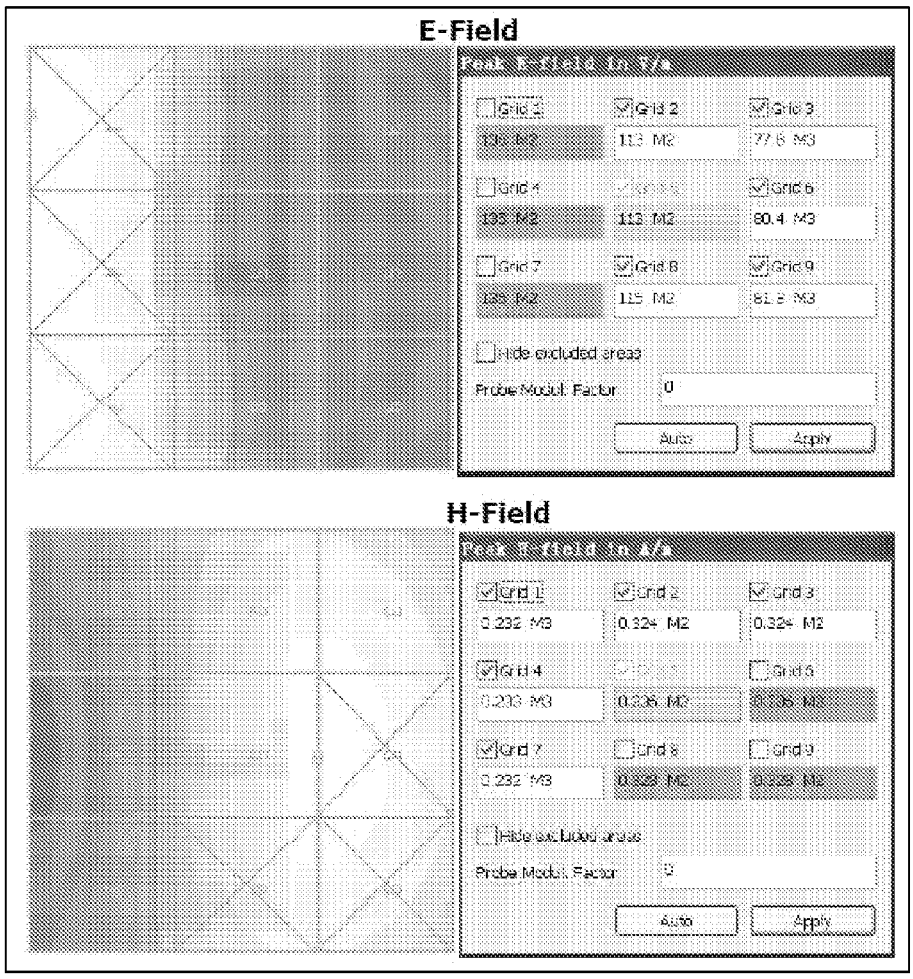
FIG. 6 shows a test result of HAC of the third test example as shown in FIG. 5A.

In FIG. 6 a test result of HAC (hearing aid compatibility) of the third test example is shown, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

Figure 7A:
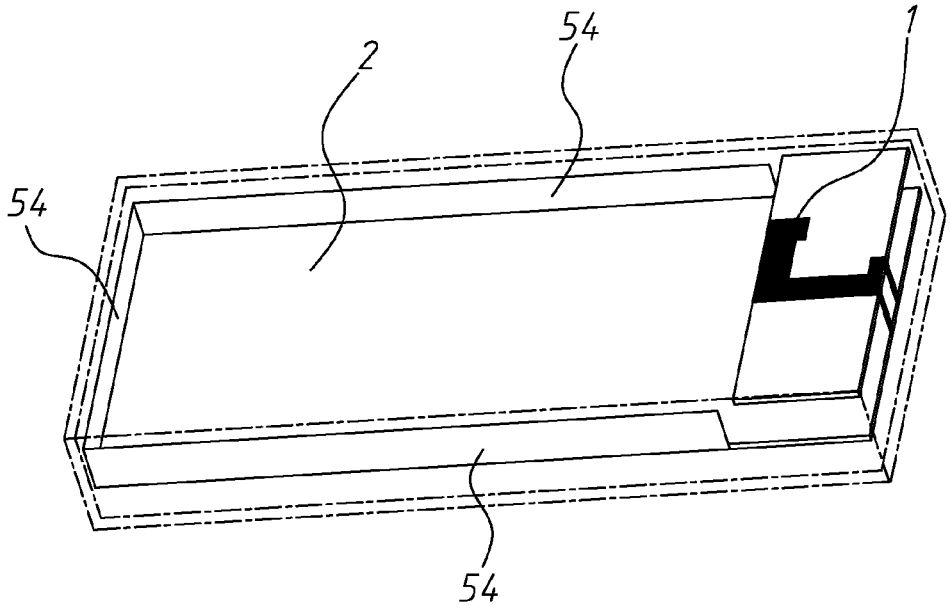
FIG. 7A to FIG. 7B are schematic views of an antenna in a fourth test example of the present invention.
Figure 7B:
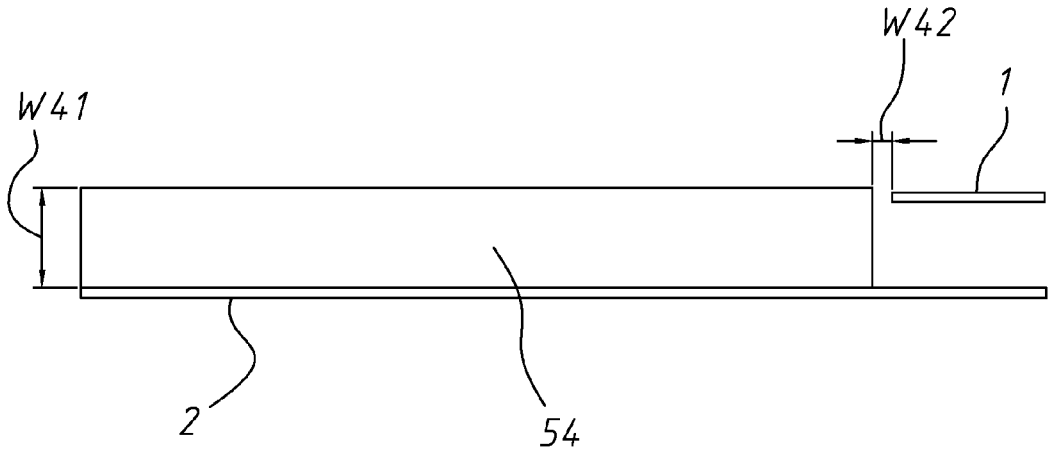

FIGS. 7A and 7B show a fourth test example of the present invention, in which the antenna is same by size as that of the third test example, however, the grounding surface 2 of the antenna is provided on its three sides each with a metal frame 54, the sizes of it are list below:

W41=7.5 mm
W42=2 mm

Figure 8:
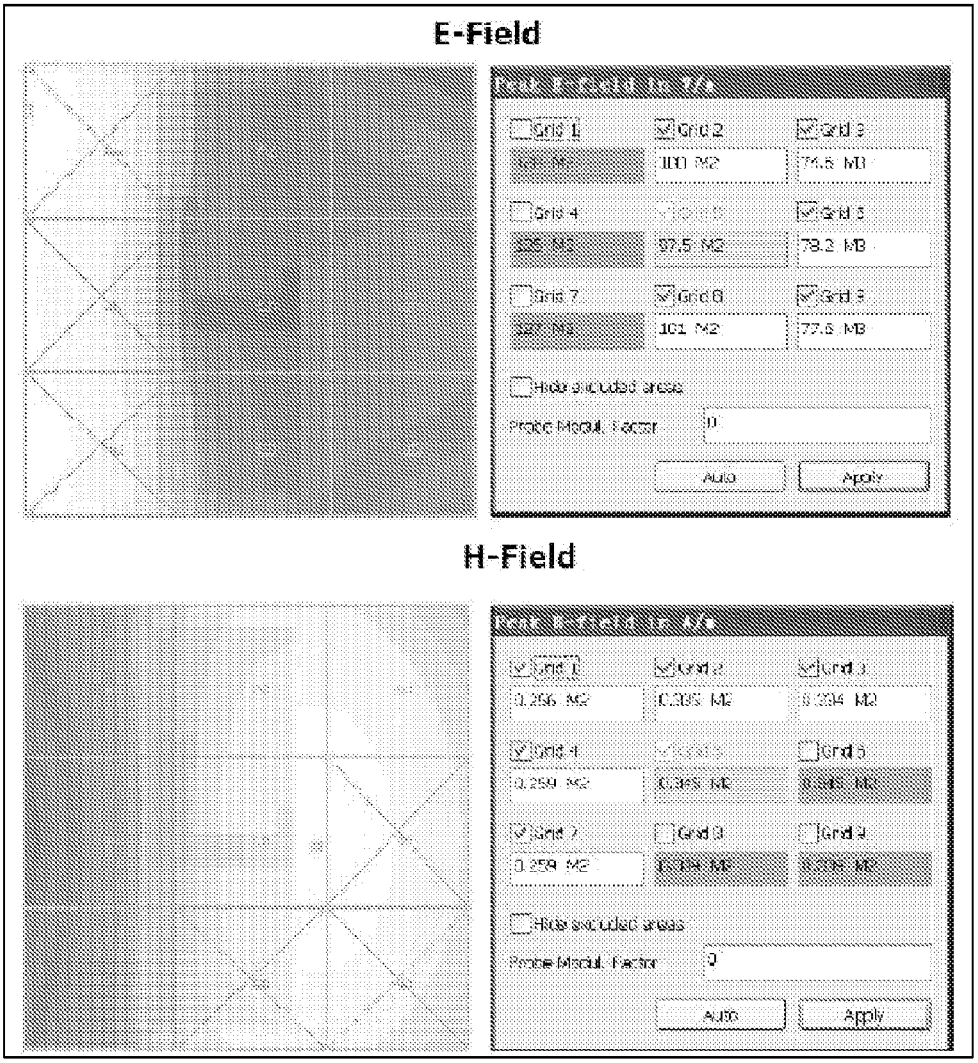
FIG. 8 shows a test result of HAC of the fourth test example as shown in FIG. 7A.

In FIG. 8 a test result of HAC (hearing aid compatibility) of the fourth test example is shown, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

Figure 9A:
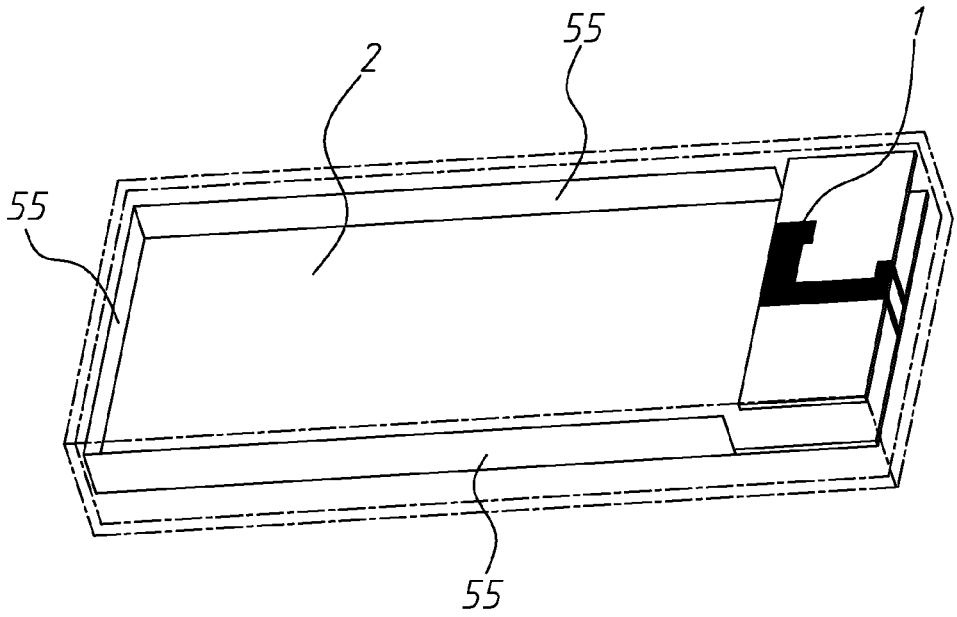
FIG. 9A to FIG. 9B are schematic views of an antenna in a fifth test example of the present invention.
Figure 9B:
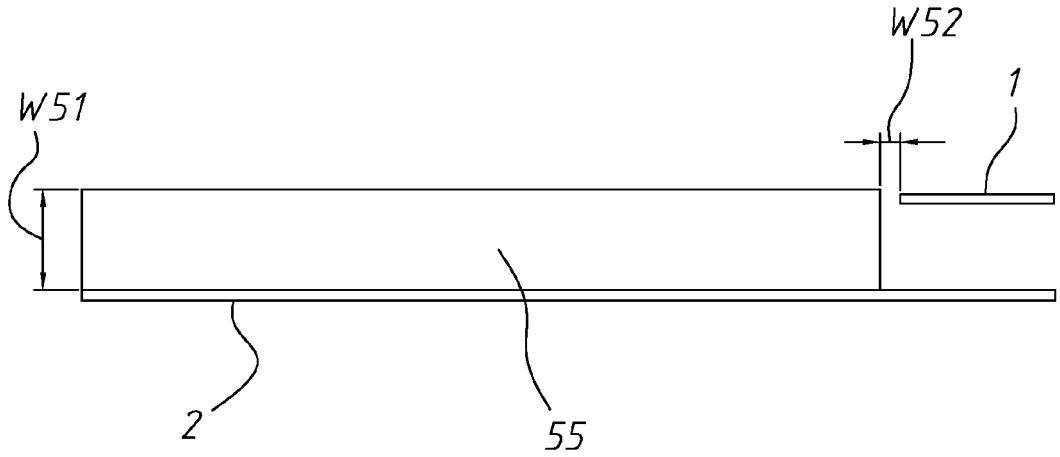

FIGS. 9A and 9B show a fifth test example of the present invention, in which the antenna is same by size as that of the fourth test example, however, the grounding surface 2 of the antenna is provided on its three sides each with a metal frame 55, the sizes of it are list below:

W51=10 mm
W52=2 mm

Figure 10:
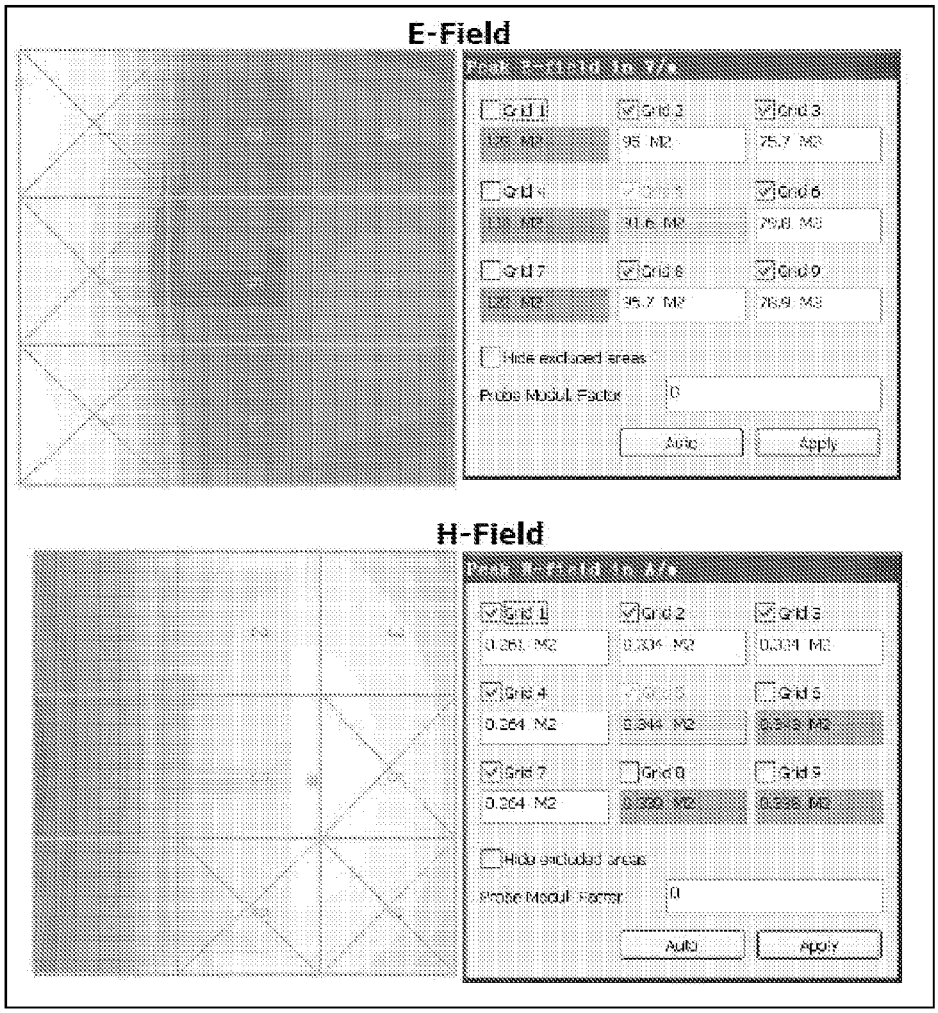
FIG. 10 shows a test result of HAC of the fifth test example as shown in FIG. 9A.

In FIG. 10 a test result of HAC (hearing aid compatibility) of the fifth test example is shown, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

Figure 11A:
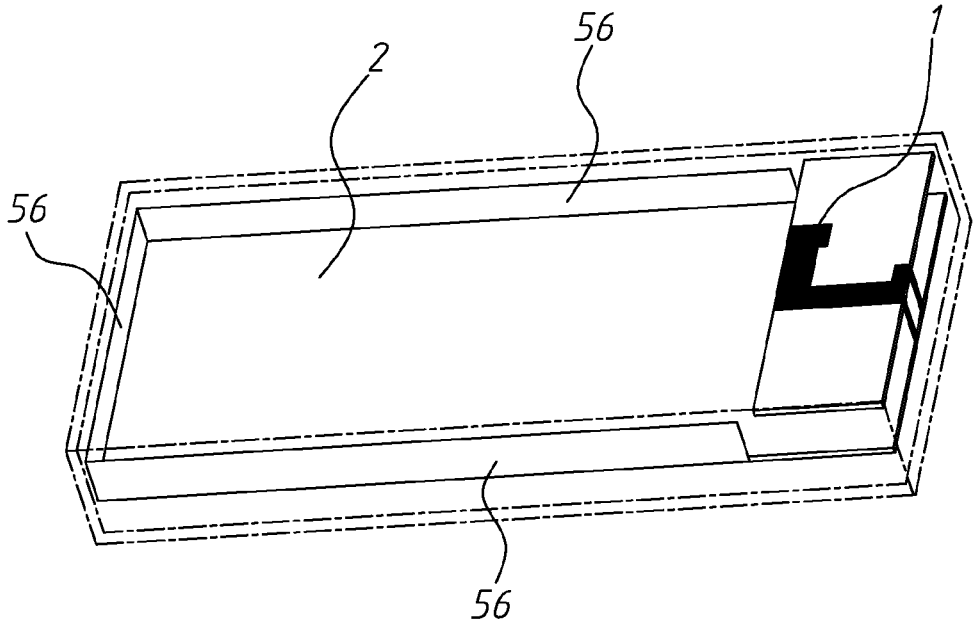
FIG. 11 A to FIG. 11B are schematic views of an antenna in a sixth test example of the present invention.
Figure 11B:
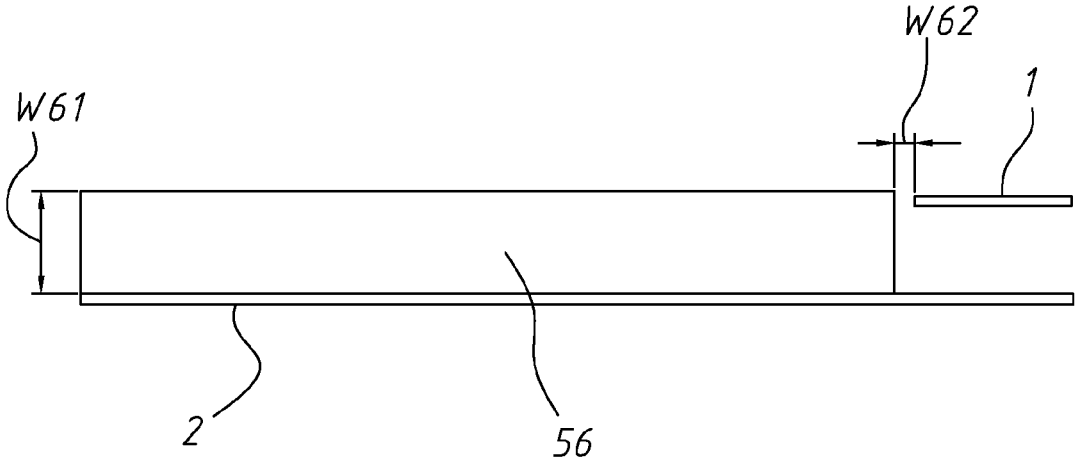

FIGS. 11A and 11B show a sixth test example of the present invention, in which the antenna is same by size as that of the fifth test example, however, the grounding surface 2 of the antenna is provided on its three sides each with a metal frame 56, the sizes of it are list below:

W41=12.5 mm
W42=2 mm

Figure 12:
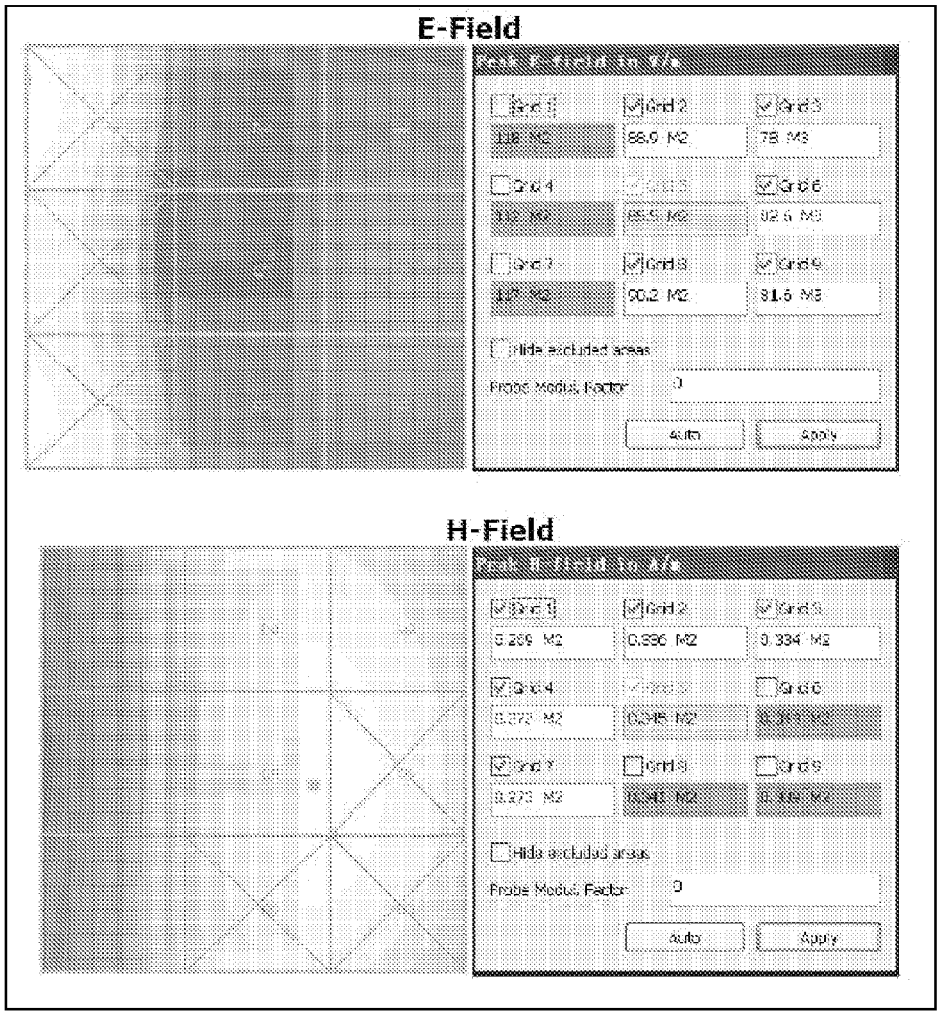
FIG. 12 shows a test result of HAC of the sixth test example as shown in FIG. 11A.

In FIG. 12 a test result of HAC (hearing aid compatibility) of the fifth test example is shown, the upper left part is a diagram of an E-field (electric field) of the imitative test plane, the upper right part expresses the maximum electric field strength of each block; the lower left part is a diagram of an H-field (magnetic field) of the imitative test plane, the lower right part expresses the maximum magnetic field strength of each block.

By comparing of the test results of the above six examples, we get the following table:

| | Height of the frame (mm) | Total efficiency (%) | Directivity (dB) | HAC (hearing aid compatibility) E-field (V/m) | HAC (hearing aid compatibility) H-field (A/m) |
|---|---|---|---|---|---|
| Example 1 | 0 | 73.004 | 4.84 | 131 | 0.316 |
| Example 2 | 2.5 | 73.6553 | 5.01 | 123 | 0.327 |
| Example 3 | 5 | 73.6114 | 5.15 | 115 | 0.336 |
| Example 4 | 7.5 | 72.3726 | 5.32 | 101 | 0.345 |
| Example 5 | 10 | 71.8404 | 5.38 | 95.7 | 0.344 |
| Example 6 | 12.5 | 71.1896 | 5.43 | 90.2 | 0.345 |

And we get a conclusion as below from the above table:

1. at least a metal frame is provided near by a grounding surface of the antenna to improve the near-field quantity (for about 3 dB) of an electric field of an HAC (hearing aid compatibility) tested plane;
2. one metal frame or plural metal frames can be provided at one side or at a plurality of sides of the grounding surface of the antenna, both are able to reduce the near-field quantity of the electric field of the HAC tested plane;
3. such a structure basically has no influence on the efficiency of the antenna, while is substantially benefit to adjustment of hearing aid compatibility (HAC);
4. the near-field quantity of the HAC (hearing aid compatibility) tested plane will be lowered gradually in pursuance of increasing of the heights of the metal frames.

From the above specification, it is proved that the present invention provides an effective method for improving compatibility of a hearing aid with an antenna.

Having now particularly described and ascertained the novelty and improvement of my invention and in what manner the same is to be performed, what we claim will be declared in the claims followed.

The invention claimed is:

1. A method for improving a compatibility of a hearing aid with an antenna located in a mobile phone, connecting said antenna to a grounding surface, locating at least one metal frame perpendicular to said grounding surface changing a direction of radiation of said antenna and enhancing directivity of said antenna on a side away from the hearing aid, and reducing a quantity of radiation proceeding toward said hearing aid and improving a near-field quantity (for about 3 dB) of an electric field of an HAC (hearing aid compatibility) tested plane, wherein said antenna has a metal radiating member located on a carrier plate, said radiating member and said carrier plate are parallel to and spaced apart from said grounding surface by a height of said metal frame, said metal radiating member has a grounding spot and a feed in spot extending downwardly and connected to an edge of said grounding surface;

wherein said grounding spot and said feed in spot are electrically connected to an edge of said carrier plate;

wherein said radiating member has two opposing edges aligning with two opposing edges of said carrier plate.

2. The method for improving the compatibility of the hearing aid with the antenna located in the mobile phone as claimed in claim 1, wherein said metal frame is located adjacent to a corresponding edge of said grounding surface.

3. The method for improving the compatibility of the hearing aid with the antenna located in the mobile phone as claimed in claim 1, wherein said at least one metal frame includes at least two metal frames, each metal frame of said at least two metal frames is located adjacent to a corresponding edge of at least two edges of said grounding surface.

4. A method for improving the compatibility of the hearing aid with the antenna located in the mobile phone as claimed in claim 1, wherein said method further increases height of said at least one metal frame to reduce near-field quantity of said electric field of said HAC (hearing aid compatibility) tested plane.

5. A method for improving the compatibility of the hearing aid with the antenna located in the mobile phone as claimed in claim 1, wherein said carrier plate has a width equal to a width of said grounding surface.

* * * * *